US006491134B2

(12) United States Patent
Ryan et al.

(10) Patent No.: US 6,491,134 B2
(45) Date of Patent: Dec. 10, 2002

(54) AIR-COUPLED SURFACE WAVE STRUCTURES FOR SOUND FIELD MODIFICATION

(75) Inventors: James G. Ryan, Gloucester (CA); Michael R. Stinson, Gloucester (CA)

(73) Assignee: National Research Council of Canada, Ottawa (CA)

( * ) Notice: Subject to any disclaimer, the term of this patent is extended or adjusted under 35 U.S.C. 154(b) by 21 days.

(21) Appl. No.: 09/735,873

(22) Filed: Dec. 14, 2000

(65) Prior Publication Data

US 2001/0030079 A1 Oct. 18, 2001

Related U.S. Application Data

(60) Provisional application No. 60/171,119, filed on Dec. 16, 1999.

(51) Int. Cl.[7] ..... E04B 1/82
(52) U.S. Cl. ..... 181/295; 181/293; 181/30
(58) Field of Search ..... 181/286, 295, 181/284, 285, 288, 290, 292, 293, 30

(56) References Cited

U.S. PATENT DOCUMENTS 4,244,439 A 1/1981 Wested
4,821,839 A * 4/1989 D'Antonio et al. ..... 181/286
5,160,816 A * 11/1992 Chlop ..... 181/286
5,401,921 A * 3/1995 D'Antonio et al. ..... 181/286
5,969,301 A * 10/1999 Cullum, Jr. et al. ..... 181/286
6,290,022 B1 * 9/2001 Wolf et al. ..... 181/286

OTHER PUBLICATIONS

Stinson et al.: "Surface Wave Formation at an Impedance Discontinuity", J. Acoust. Soc. Am., 102 (6), Dec. 1997, pp 3269–3275.

McAninch et al.: "Propagation of Quasiplane Waves Along an Impedance Boundary", AIAA 26$^{th}$ Aerospace Sciences Meeting, Jan. 11–14, 1988, Reno, Nevada pp 1–11.

* cited by examiner

*Primary Examiner*—Khanh Dang
(74) *Attorney, Agent, or Firm*—Freedman & Associates

(57) ABSTRACT

A surface wave apparatus is disclosed having reduced sound attenuation across a surface along a known path having a path distance when compared to sound attenuation along a same path distance through air. The surface wave apparatus includes a plurality of cells defining a first surface. Sound presented at the first surface forms a surface wave over the surface and proximate thereto. Each cell includes four bounding walls and a bottom. Two of the bounding walls act to guide the sound within the known path and two are disposed across the known path to form a structure supporting formation of surface waves.

36 Claims, 6 Drawing Sheets

AIR-COUPLED SURFACE WAVE STRUCTURES FOR SOUND FIELD MODIFICATION

This application claims the benefit of Provisional application Ser. No. 60/171,119, filed Dec. 16, 1999.

FIELD OF THE INVENTION

This invention relates to a sound-field-modifying structure and more particularly to a sound-field-modifying structure that makes use of air-coupled surface waves to provide noise reduction, spectral shaping, or sound amplification.

BACKGROUND OF THE INVENTION

The modification of sound fields using passive, physical structures is useful in many application areas. These include applications where noise reduction or attenuation is the main goal, as with highway noise barriers or sound-absorbing ceiling tiles. In other applications, sound amplification is desired, as with parabolic dish microphones. And others involve attenuation in some frequency bands resulting in relative amplification in others, i.e., spectral shaping of sounds, as with the design of concert halls. Typical strategies include the use of porous damping materials, the incorporation of Helmholtz resonators, and the use of barriers, shaped reflectors and diffusers.

It is also possible to make use of an entirely different physical mechanisms, such as air-coupled surface waves, to achieve improvements in performance in all of these areas. Air-coupled surface waves form and propagate over porous surfaces that have been designed to have appropriate acoustic impedance. Acoustical energy collects into the surface wave and is localised close to the surface as it propagates over the surface. These structures are useful for sound attenuation through the introduction of acoustically absorbing materials into sections of the surface wave structure, so that acoustical energy is trapped into a surface wave and then dissipated by the absorbing materials. Thus, improved noise reduction is achieved.

For example, in U.S. Pat. No. 4,244,439 entitled "Sound-absorbing structure", issued to Wested, a structure for use to reduce traffic noise is proposed. The mechanism used to reduce the noise, although not explicitly noted as such, is air-coupled surface waves.

Different frequency ranges are addressable in different fashions, so spectral shaping of different signal types such as speech, music, and noise are achievable. Optionally, a surface wave structure is designed so that it behaves differently for sound arriving from different directions: there is a directivity potential that is optionally exploited. Also, surface waves propagate with a phase speed that is different than the free field sound speed.

Efforts are often made to reduce noise in boardrooms and conference rooms using absorptive panels and carpets. However, such noise control efforts also reduce the intensity level of speech signals resulting in difficulties hearing individuals at opposing ends of a room, particularly for long rooms. This reduced audibility is even more of a problem when a microphone is being used to pick up the speech signals because the visual cues are not present at the remote listening end. Two procedures in current use to reduce the above noted problem are (i) reinforcing the speech signals along the length of a boardroom by installing an overhead, ceiling-mounted reflective panel and (ii) use of electronic amplification with microphones at each talker position. However, the installation of an overhead reflector can involve considerable structural, aesthetic and lighting considerations and, moreover, the effects of the original noise control efforts are offset by such an approach. Electronic amplification requires electronic hardware, such as microphones, amplifiers, loudspeakers and mixers, and a technician to ensure that equipment is running properly and levels are appropriately set.

It would be advantageous to provide a method and structure for improving acoustic communication.

SUMMARY OF THE INVENTION

According to an embodiment of the invention there is provided a surface wave apparatus having reduced sound attenuation across a surface along a known path having a path distance when compared to sound attenuation along a same path distance through air comprising:

a plurality of cells defining a first surface for supporting acoustical communication between a sound field incident on the first surface and the plurality of cells, each cell including:

an end that is approximately acoustically sealed such that most acoustic energy does not pass therethrough and spaced from the first surface for providing an effective acoustic surface impedance for which air-coupled surface waves form and propagate at selected sound frequencies, at least a bounding sidewall having 2 opposing bounding sides, between the first surface and the end, that are approximately acoustically sealed such that most acoustic energy does not pass therethrough, the 2 opposing bounding sides of adjacent cells approximately defining boundaries of the known path, the at least a bounding sidewall having further sides between the first surface and the end spaced apart by a distance less than a wavelength of sound at a known frequency and each disposed across the known path on the surface wave apparatus.

DETAILED DESCRIPTION OF AN EMBODIMENT OF THE INVENTION

Figure 1:
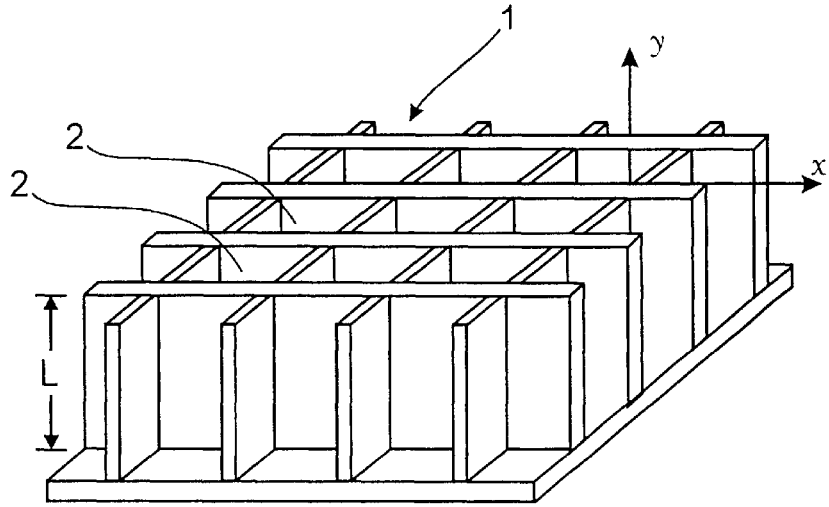
Figure 1 (PRIOR ART)
FIG. 1. Sketch of generic celled structure for surface wave formation

Air-coupled surface waves form over surfaces for which the effective acoustical impedance has a spring-like reactive component that is greater than the resistive component. A known form of these surfaces includes a plurality of cells having a length along the direction of propagation of the surface wave that is significantly less than one wavelength and preferably in the order of ¼ wavelengths in length or smaller. The surface wave is a collective excitation that involves motion within each cell and adjacent cells and the fluid (air) above the surface and is characterised by a sound pressure magnitude that has an exponential decrease in height. In the past, by placing sound dampening material within a cell, sounds were attenuated more effectively for roads. Such a structure is presented in Wested though the scientific principles thereunder are not fully explained.

In previously in M. R. Stinson and G. A. Daigle (1997). "Surface wave formation at an impedance discontinuity", J. Acoust. Soc. Am. 102, 3269–3275 is presented a scientific study of surface waves, which is incorporated herein by reference. The study employed a cell structure having an open upper end for capturing a sound and for "trapping" the sound into a surface wave. The surface waves were then studied to determine characteristics thereof. Acoustic signals were provided from different distances away from the cell structure to measure the effects that this distance would have.

It has now been found that acoustical energy in the air-coupled surface wave is localised to a surface and does not substantially lessen in intensity due to spherical spreading. That said, planar spreading and other causes of sound attenuation such as absorptive materials within the cells still result in substantial attenuation of the surface wave.

It has now been found that by suitably designing a surface wave apparatus in the form of a panel structure having cells, an acoustical signal reaching a listening position has greater intensity than that which would have reached this position if the surface was acoustically hard. Therefore, a simulated sound amplification is achieved using a passive, physical structure.

By introducing sound attenuating materials or substructures into some of the cells, damping of the surface waves is achieved. By appropriate design of the sound-field-modifying structure, acoustical energy incident on the structure is "trapped" into a surface wave and then damped. Therefore, sound reduction is achieved.

The amplification or attenuation properties of the structure is achievable over selected frequency ranges. Appropriate design of the structure provides reduced attenuation—amplification—over some ranges of frequencies and increased attenuation over others, thereby achieving spectral shaping. Alternatively, the attenuation is provided for sounds entering at different angles. Thus, for example, a boardroom table is formed wherein some individuals are easily heard at another end of the table while others are not. This allows for speaker positions and recorders or witness positions.

The intention of this invention is to improve the sound modification capabilities in various application areas through the introduction of air-coupled surface wave structures.

Air coupled surface waves

When a surface meets stringent propagation conditions, sound pressure levels in surface waves are often considerably higher than what would be measured absent those stringent propagation conditions being met. Thus, a simulated amplification of acoustical signals is achieved under certain stringent conditions. This and other factors make the use of surface wave structures attractive for speech pickup by microphones in rooms, auditoria, and interiors of transportation vehicles.

It has now been found that surface wave structures can be used, for example, to improve communication in venues such as boardrooms and videoconferencing rooms for which communication is impaired by background noise. According to the invention an air-coupled surface wave structure built into a boardroom-style table or into a panel that simulates amplification and spectrally shapes speech sounds passing along its length is provided. The acoustic energy in surface waves is located near the interface and the "trapped" energy propagates along the interface. The acoustical energy density at the receiving end—the listener—is greater than the energy density in the absence of surface waves, thus achieving the goal of providing passive simulated amplification of speech signals over the length of the table. Even though the term "simulated amplification" is used, it refers to increased intensity of sound signals relative to similar signals conducted absent the apparatus of the embodiment.

A brief discussion of surface waves is provided with reference to a prototypal structure with a plurality of adjacent cells as shown in FIG. 1.

A sound wave propagating horizontally above the surface 1 interacts with the air within the cells 2 and has its propagation affected. This is understood in terms of the effective acoustic surface impedance of the structure. Plane-wave-like solutions $$p=e^{i\alpha x}e^{i\beta y} \tag{1}$$

of the Helmholtz equation, for the sound pressure p, are sought subject to the boundary condition $$(dp/dy+i\rho\omega p/Z)_{y=0}=0 \tag{2}$$

where x and y are co-ordinates as shown in FIG. 1, $k=\omega/c$ is the wave number, $\omega$ is the angular frequency, $\rho$ is the air density, $i=(-1)^{1/2}$, and an $\exp(-i\omega t)$ time dependence is assumed. Then, the terms $\alpha$ and $\beta$ are given by $$\alpha/k=[1-(\varrho c/Z)^2]^{1/2} \quad (3)$$

and $$\beta/k=-\varrho c/Z. \quad (4)$$

For a surface wave to exist, the impedance Z must have a spring-like reactance X, i.e., for Z=R+iX, require X>0. Moreover, for surface waves to be observed practically, an approximate criteria is R<X and $2<X/\varrho c<6$. The surface wave is characterised by an exponential decrease in amplitude with height above the surface.

If the lateral size of the cells are a sufficiently small fraction of a wavelength of sound, then sound propagation within the cells may be assumed to be one dimensional. For the simple cells of depth L shown in FIG. 1, the effective surface impedance is $$Z=i\varrho c \cot kL \quad (5)$$

so surface waves are possible for frequencies less than the quarter-wave resonance.

Figure 2:
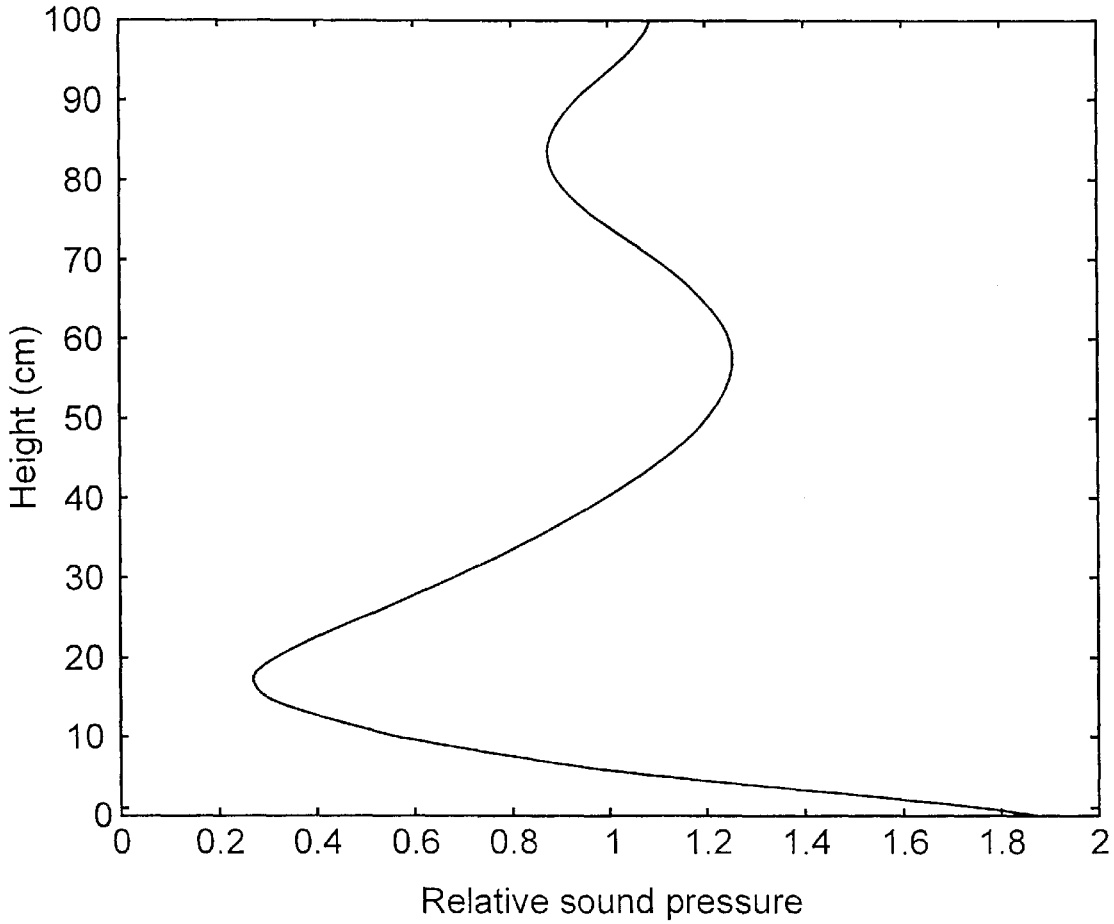
Figure 2 (PRIOR ART)
FIG. 2. Sound pressure profile above a generic structure having effective surface impedance $(0.0285+1.63i)\rho c$. The measurement vertical is 1 m in from the transition between a rigid surface and the surface wave structure; a 1000 Hz plane wave is incident on the discontinuity.

It is noteworthy that devices commonly known as surface acoustic wave (SAW) devices make use of a totally different type of interface wave, i.e., one in which the solid substrate itself is involved in the wave motion. For the air-coupled surface wave, the walls of the component cells do not necessarily move and, in fact, their motion is not an essential element for the formation of air-coupled surface waves. SAW devices operate at much higher sound frequencies and require totally different instrumentation Sound incident on and propagating over a surface wave structure will have acoustical energy channelled into a surface wave. Optionally, the formation of surface waves is described within the framework of the McAninch and Myers theory as presented in G. L. McAninch and M. K. Myers (1988). "Propagation of quasiplane waves along an impedance boundary", AIAA 26th Aerospace Sciences Meeting, paper AIAA-88-0179. They consider a line discontinuity in a plane, acoustically rigid surface on one side of the discontinuity and a surface impedance Z on the other. A plane wave propagating horizontally above the rigid half is assumed incident on the discontinuity and the evolution of the wave, horizontally and vertically, above the impedance plane is computed. A graphical example of this calculation is shown in FIG. 2. A surface with impedance $Z=(0.0285+1.63i)\varrho c$ is assumed. The vertical sound pressure profile 1 m after the discontinuity is shown, normalised by the incident wave amplitude, for a sound frequency of 1000 Hz. The large amplitude signal within 5 cm of the surface is the surface wave; its amplitude is double that of the incident plane wave.

Figure 3:
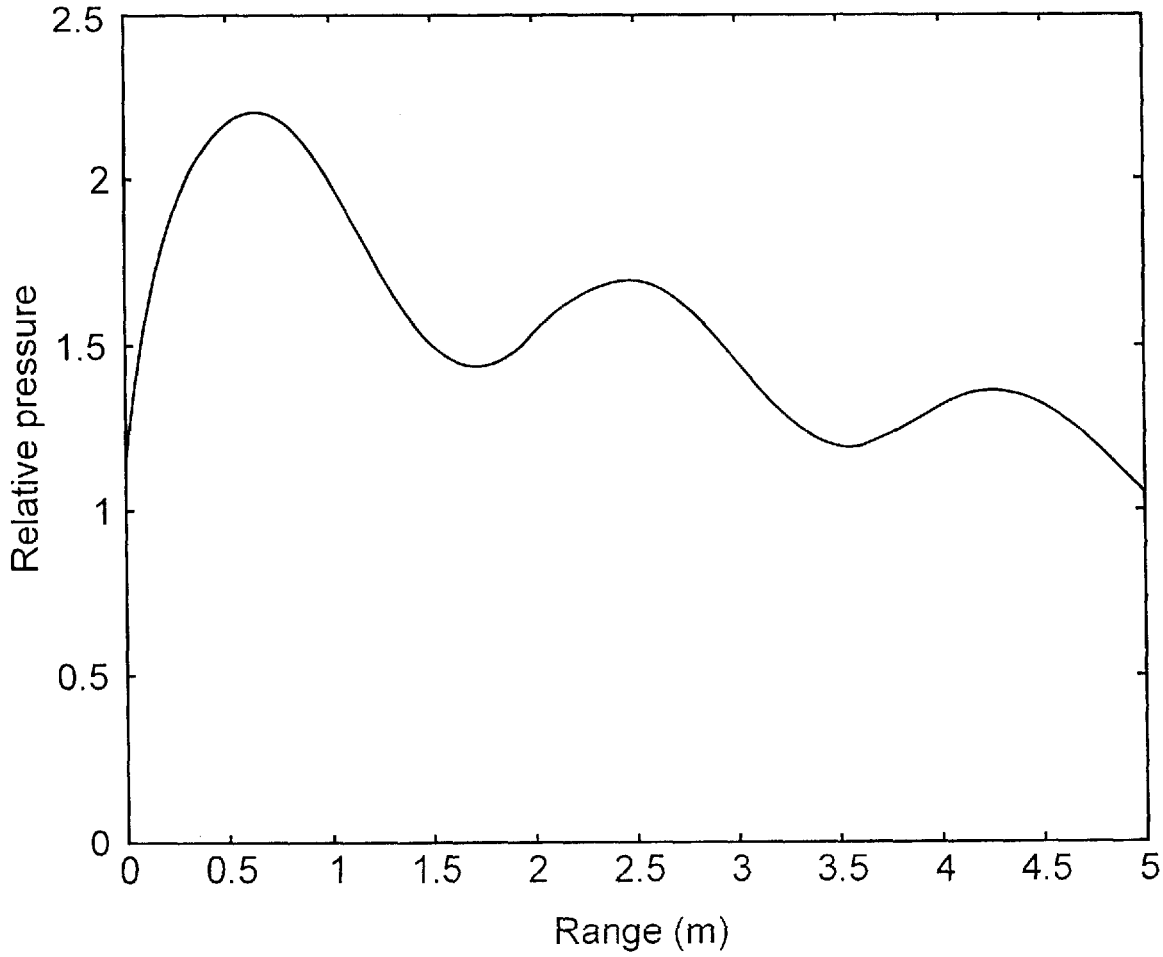
Figure 3 (PRIOR ART)
FIG. 3. The development and propagation of a surface wave, showing the variation of sound pressure along the surface of an air-coupled surface wave generic structure, with a 1000 Hz plane wave of unity amplitude incident at the discontinuity.

A graphical representation of the propagation of a surface wave, for the same impedance surface, is shown in FIG. 3. The sound pressure variation with distance from the discontinuity has been calculated for the receiver located on the surface. Up to the discontinuity at range zero, a plane wave of unity amplitude propagates horizontally. Immediately after the discontinuity the surface wave forms, acoustic energy collecting near the interface, so that the sound pressure increases. At a range of 60 cm, the pressure amplitude is more than double the incident amplitude. The surface wave then continues to propagate along the surface, its amplitude dropping with range because of the resistive component of the surface impedance. Clearly, by keeping this component small, propagation over quite long ranges becomes possible. The oscillations are due to interference—the surface wave propagates at a phase speed different than the free field sound speed at which the incident wave propagates.

Air-coupled surface waves for sound field modification

It has now been found that air-coupled surface waves are useful for providing simulated amplification, attenuation, and amplification. These aspects are illustrated here in turn.

Figure 4:
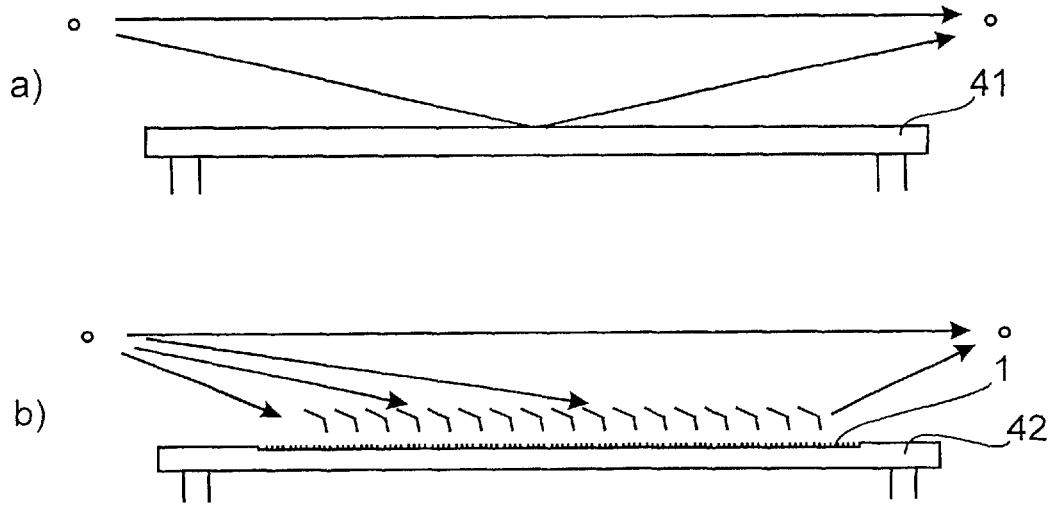
FIG. 4. Sound reaching a receiver at the end of a table over (a) rigid surface and (b) over a surface wave structure. Over the surface wave structure, acoustic energy is trapped near the surface and propagates without inverse-square reductions, so the received sound pressure level (SPL) can be considerably higher. This gives effective amplification.

FIG. 4 shows a sketch comparing sound over a planar boardroom table 41 and air-coupled surfaces providing simulated amplification of speech signals shown as small ] over the length of a surface 1 in the form of a boardroom table, for example. Above the rigid table surface 41 of the panel shown in (a), sound from a talker spreads out in all directions and the sound intensity decreases in inverse proportion to the square of the distance from the speaker, for both a direct and a reflected component. There are reflections from walls and ceilings but, since typically noise control measures are present to reduce reflections, their effects are preferably minimal. In the case of (b), the rigid surface is replaced by a surface 1 that supports air-coupled surface waves. Acoustical energy is "trapped" in a surface wave and propagates with little attenuation to the end of the surface 1 where an outcoupler 42 provide for the energy to be released in an approximate continuous direction. The sound level is substantially higher at an end of the table of (b) where the outcoupler is present than it is at a similar end of the panel in (a).

Figure 5:
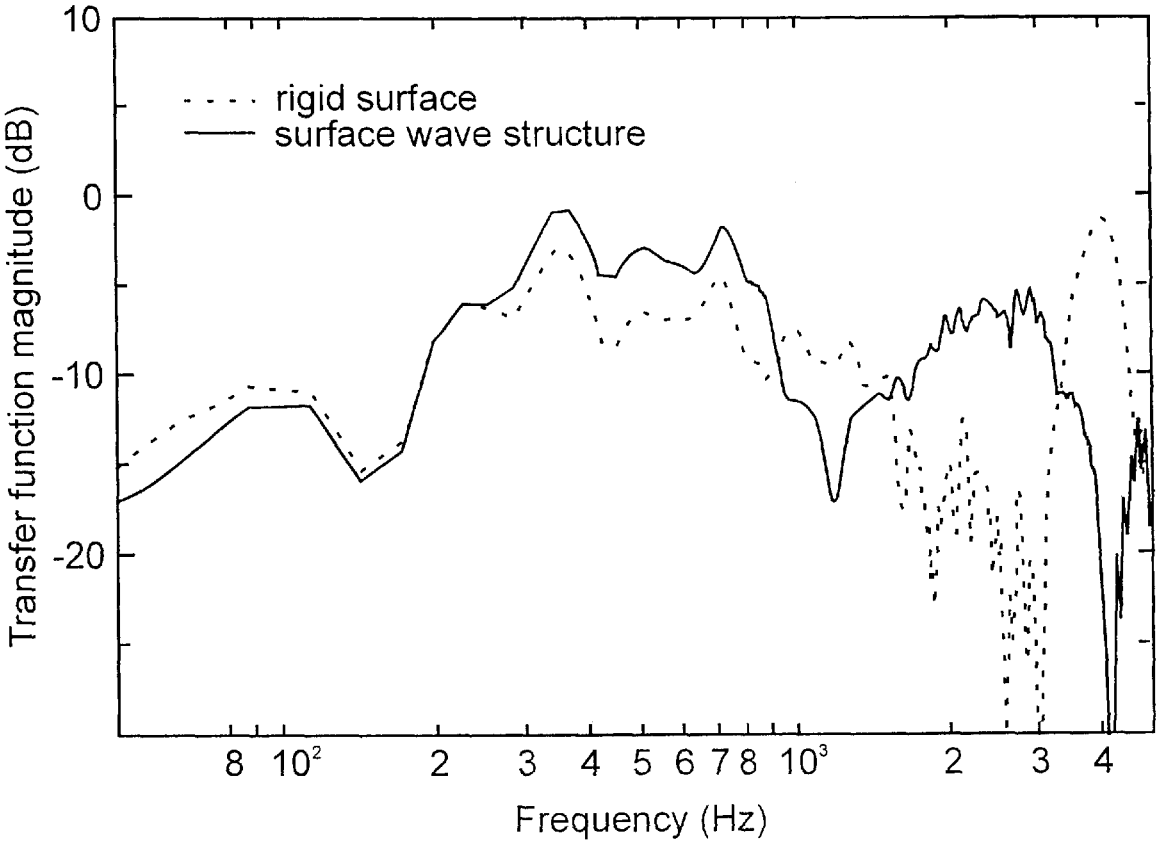
FIG. 5. The effect of introducing a surface wave structure on the top of a boardroom table. There is an increase in sound pressure level of nearly 5 dB in the 200 Hz–1000 Hz range of frequency.

Experimental verification of this operation is provided in FIG. 5. Measurements of sound propagation were made above a plastic panel 2'×12', with cells approximately ½" square and 1" deep. The cells were open at the top and individually sealed at the bottom. Source and receiver were at opposite ends of the surface wave structure, 40 cm above the plane of the surface. The solid curve shows the measured SPL as a function of frequency. Repeating the measurements with the surface wave structure covered by a thin, rigid aluminium plate, the dashed curve is obtained. The increase in SPL between 200 Hz and 1000 Hz is due to the formation and effect of the surface wave. There is additional structure at higher frequencies that may be understood in terms of interference between direct and reflected waves and the shifting of the interference minima with surface treatment. The increased levels in the 200 Hz–1000 Hz range are due to the surface wave effect over the structure and are nearly 5 dB for these frequencies.

Figure 6:
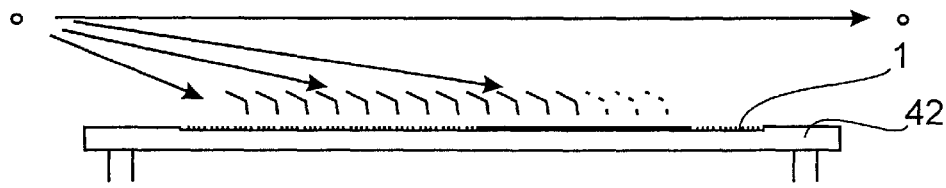
FIG. 6. By incorporating sound damping into part of the surface structure, attenuation of acoustical noise can be achieved. In this example, sound from a source reaches the left part of the surface wave structure and a surface wave forms and grows as energy is taken from the incident field. Part way along the structure, damping material in the structure attenuates the surface wave, thus reducing the overall sound field at the listener position.

The potential for attenuation of acoustical noise is illustrated in FIG. 6. A portion of the surface wave structure contains sound absorbing material. Sound reaching the start of the structure collects into a surface wave. When the surface wave reaches the absorption region, the acoustic energy is absorbed. Therefore, little sound energy reaches the outcoupler 42.

A surface wave structure is not restricted to just one of simulated amplification, amplification, and attenuation. Optionally, some parts of the structure are designed to provide amplification, over a certain band of frequencies, while other different regions are designed to provide attenuation, over a same or different band. Some of the possible configurations are discussed hereinbelow. By increasing or decreasing the sound levels in different bands of frequencies, the frequency response is shaped to a desired target frequency response. This more general application of air-coupled surface wave structures is referred to herein as spectral shaping. Sound-field modification refers to any or all of spectral shaping, simulated amplification, sound attenuation, and sound amplification.

This invention relates to a sound-field-modifying structure for which one or more faces has a plurality of adjacent cells, each with transverse dimensions less than a fraction of a wavelength corresponding to the highest frequency of interest. The structure is configured to provide noise reduction, spectral shaping, simulated amplification, and/or sound amplification, making use of air-coupled surface waves that form and propagate over the surface. Optionally, the structure takes the form of a flat panel or a surface treatment that is built into a wall or table as, for example, an inlay. Further optionally, the structures are mounted on three-dimensional objects such as, but not limited to, a sphere, hemisphere or polyhedron. Of course, other structural installations or form factors are supported as long as they fall within the scope of the claims that follow.

Figure 7:
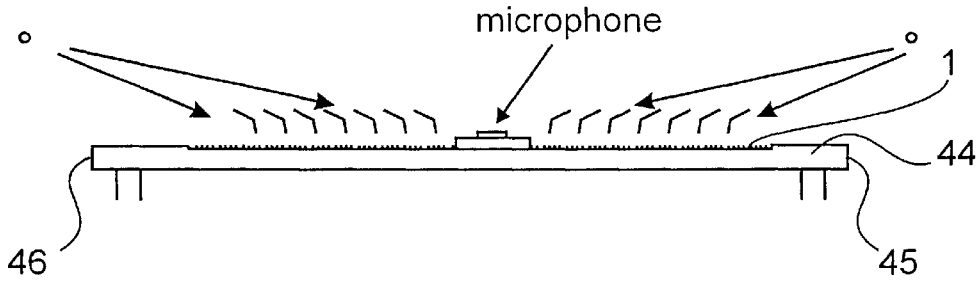
FIG. 7. Surface wave structures can be optimised for the transmission of speech signals to a sound pickup position.

Referring to FIG. 7, an embodiment of the invention for providing sound amplification is shown. Here a microphone is disposed within the surface wave region of the device. The surface wave contains substantially more sound energy than a simple sound signal and, as such, the microphone senses an amplified sound wave. For example, if the cells were the full width of the table and an incoupler 44 was used to improve coupling efficiency into the surface wave device. The microphone would sense the individuals at the ends of the table 45 and 46 as louder than those on other sides of the table. This is because speech of those individuals at 45 and 46 forms surface waves whereas speech of other individuals across the table will not. Of course, if other individuals spoke other than toward the microphone, surface waves may result. As such, individuals at 45 and 46 would also receive simulated amplified speech from other individuals near opposing ends of the table. The simulated amplification is improved through the presence of an outcoupler such as a solid surface acoustically reflective. It has been found that a wood frame is well suited to providing outcoupler functionality. Alternatively, the outcoupler is integral to the surface wave structure, which is designed to reduce internal reflection of surface waves and thereby improve outcoupling of sound.

Potential applications for the invention include, but are not limited to, enhancement of speech across long boardroom tables including amplification relative to free space sound signals and/or sound shaping, sound enhancement for conducting sound to a transducer, and sound signal noise filtering. Surface wave structures are useful for improving the signal-to-noise ratio for a sound pickup devices when the noise is easily distinguishable in terms of direction of propagation or frequency range thereby permitting improved speech intelligibility for speech recognition systems, for example, and better sound quality for hands free telephony and teleconferencing facilities, for example.

Various features, refinements and options are contemplated within the scope of the invention. For example, the structure, with all other refinements, may be a self-contained panel that is mounted on a wall, tabletop or ceiling. Alternatively, it is a structure that is built into the target wall or table, as an integral part of the target. Further alternatively, it is a free standing structure.

Though the depicted embodiments show a flat surface, the invention works with curved surfaces as well. It is possible that in some applications a curved surface achieves better coupling of the sound field to the surface wave.

In an embodiment, the structure is optimised for sound pickup at a position on the surface where a microphone will be mounted (as sketched in FIG. 7). Alternatively, it is optimised for generating acoustic signals at a listener's ear position.

Figure 8A:
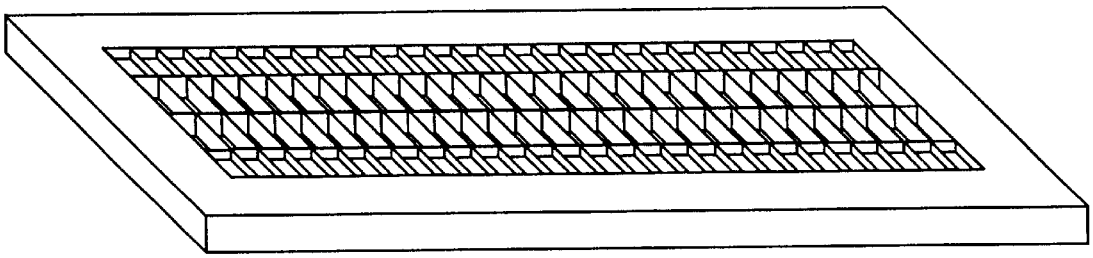
FIGS. 8*a* and 8*b*. Surface wave structure containing (a) sections of different depths, each section configured to address a specific frequency range and (b) a central region with damping material to dissipate surface wave energy.
Figure 8B:
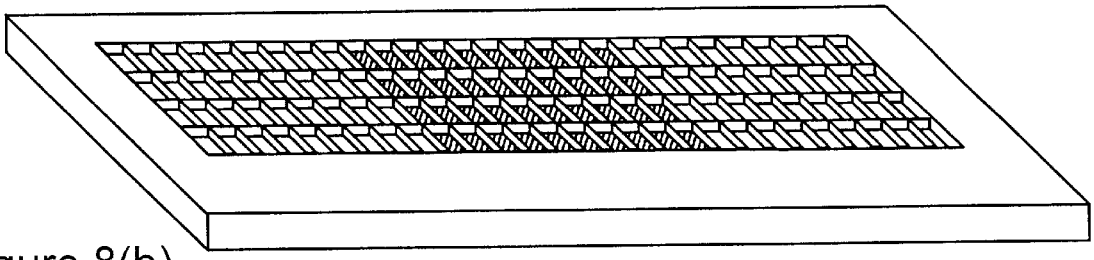

In an embodiment one or more cell is provided with damping materials in order to attenuate a surface wave. As noted above, the depth and the damping need not be the same for each cell and can vary over the surface of the structure. For example, narrow strips tuned for different ranges of frequencies, are arranged in parallel fashion, as sketched in FIG. 8(*a*). Or, damping material placed in the central region of the surface as in FIG. 8(*b*) such that a surface wave from either direction forms, builds in strength over the non-damping sections, then is dissipated as it propagates over the damped section.

Figure 9A:
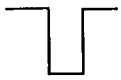
FIGS. 9*a* to 9*d*. Surface wave structure containing sections of different depths, each section configured to address a specific frequency range.
Figure 9B:
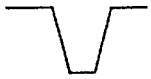
Figure 9C:
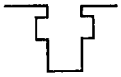
Figure 9D:
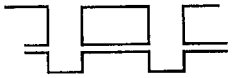

The cross section of the component cells have one of any of a number of cross sectional shapes including square, triangular, circular and hexagonal. Different surface impedance functions can be obtained by having the cell cross section change with depth. This includes the possibility of a physical coupling between cells below their top surface, as indicated in FIG. 9*d*. Some potential cell geometries are shown in FIGS. 9*a* to 9*d*. The use of different shapes allows for operation of the surface wave device to be different along different directions over the surface of the device.

Figure 10:
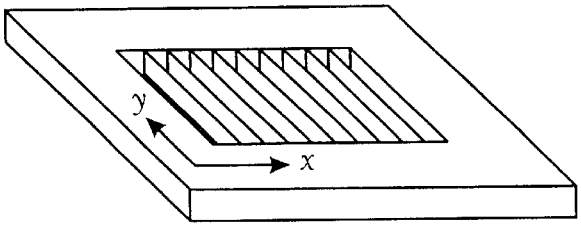
FIG. 10. Surface wave structure with cellular structure opened up in one direction. Surface waves will form along x direction only.

Directional performance is achieved by maintaining a cellular separation in one transverse direction only. The surface structure shown in FIG. 10 supports surface waves in the x direction only. Thus, in the x direction simulated amplification results and in the y direction sound travels through air and is attenuated normally.

Figure 11:
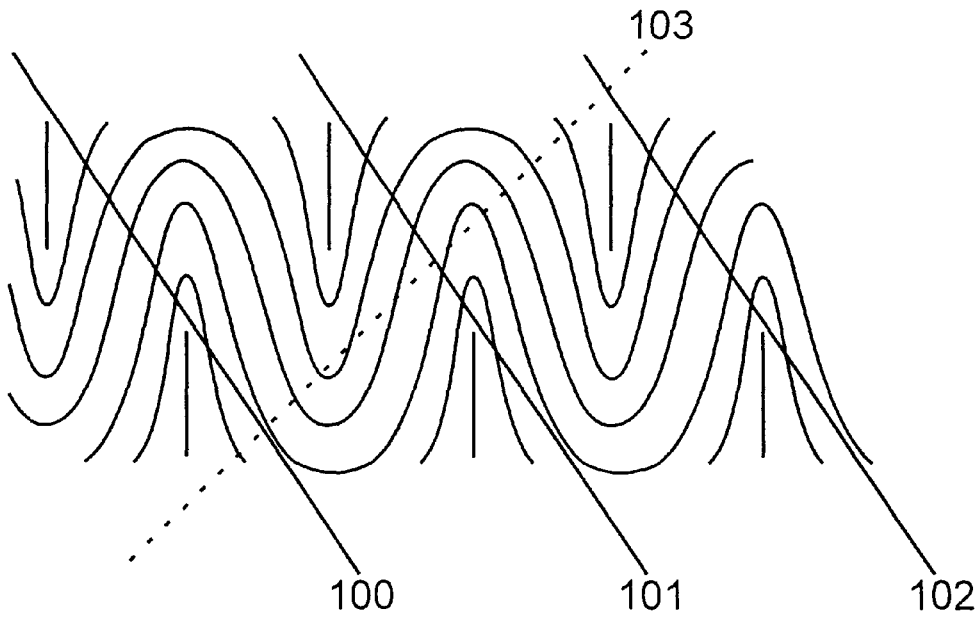
FIG. 11. Surface wave device having irregular shaped cells.

Referring to FIG. 11, an embodiment of a surface wave device having irregular shaped cells is shown. The lines 100, 101 and 102, show directions of sound wherein surface waves are formed. The line 103 shows a direction in which surface waves are impeded.

Figure 12:
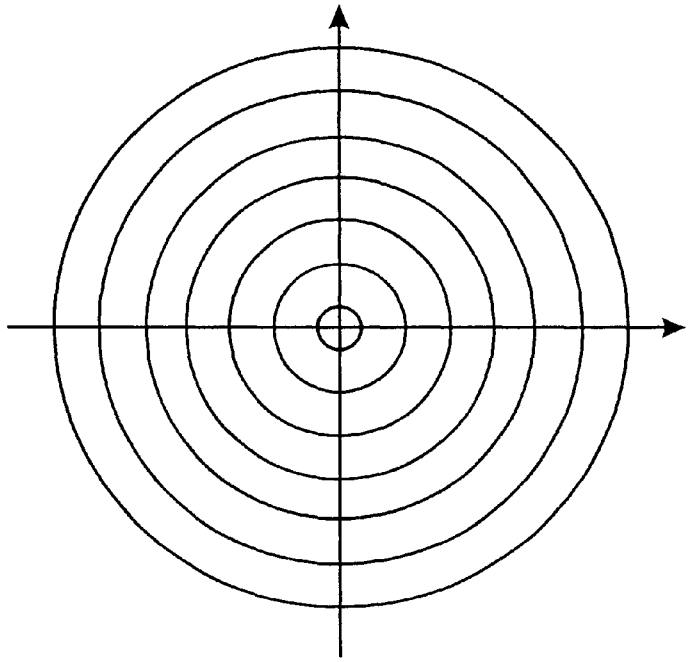
FIG. 12. Surface wave device having circular cells arranged in concentric circles.

Referring to FIG. 12, a surface wave device having circular cells arranged in concentric circles is shown. Here, surface waves propagate through a centre of the circle but generally do not form otherwise. Of course, the size of the circles and of the overall circular structure will affect performance and frequency response characteristics are governed by the known principles of surface waves.

Preferably, the surface of the surface wave apparatus is covered with acoustically transparent material to prevent a build up of dirt or dust within the cells which may act to attenuate sound therein.

Numerous other embodiments may be envisaged without departing from the spirit or scope of the invention.

What is claimed is:

1. An air coupled surface wave apparatus having reduced sound attenuation across a surface along a known path having a path distance when compared to sound attenuation along a same path distance through air comprising:

a plurality of cells defining a first surface for supporting acoustical communication between a sound field incident on the first surface and the plurality of cells, each cell including:

an end that is approximately acoustically sealed such that most acoustic energy does not pass therethrough and spaced from the first surface for providing an effective acoustic surface impedance for which air-coupled surface waves form and propagate at known sound frequencies, at least a bounding sidewall between the first surface and the end and having 2 opposing bounding sides that are approximately acoustically sealed such that most acoustic energy does not pass therethrough, the 2 opposing bounding sides of adjacent cells approximately defining boundaries of the known path, the at least a bounding sidewall having further sides between the first surface and the end spaced apart by a distance less than a wavelength of sound at the known frequency and each disposed across the known path on the surface wave apparatus.

2. A surface wave apparatus as defined in claim 1 wherein the bounding sides are spaced apart a distance sufficiently proximate one another that the surface wave is constrained along the known path by the bounding sides.

3. A surface wave apparatus as defined in claim 2 wherein the ends are closed.

4. A surface wave apparatus as defined in claim 3 wherein the surface is substantially flat.

5. A surface wave apparatus as defined in claim 4 wherein the surface is other than planar.

6. A surface wave apparatus as defined in claim 2 wherein the distance between the further sides is less than or equal to ¼ wavelength of sound at a selected frequency.

7. A surface wave apparatus as defined in claim 6 wherein the selected frequency is within an audible range of between 40 Hz and 22 KHz.

8. A surface wave apparatus as defined in claim 7 wherein the selected frequency is within a wide band telephony range of between 200 Hz and 8 KHz.

9. A surface wave apparatus as defined in claim 8 wherein the selected frequency is within a telephony range of between 300 Hz and 3.7 KHz.

10. A surface wave apparatus as defined in claim 1 wherein the known path is a straight path and wherein the cells sides form an approximate square.

11. A surface wave apparatus as defined in claim 1 wherein the known path is a curved path and the cells are other than square.

12. A surface wave apparatus as defined in claim 1 wherein the further sides are approximately acoustically sealed such that most acoustic energy does not pass therethrough and comprising cells along each of at least two known paths that cross each other.

13. A surface wave apparatus as defined in claim 12 wherein cells form a plurality of paths, some paths for forming surface waves from sound substantially at some frequencies and others for forming surface waves from sound substantially at other frequencies.

14. A surface wave apparatus as defined in claim 13 wherein a structure of the cells acts to dampen sound along one path relative to sound along another path.

15. A surface wave apparatus as defined in claim 1 wherein cells form a plurality of paths, some paths for forming surface waves from sound substantially at some frequencies and others for forming surface waves from sound substantially at other frequencies.

16. A surface wave apparatus as defined in claim 15 wherein cell structure acts to dampen sound along one path relative to sound along another path.

17. A surface wave apparatus as defined in claim 1 comprising an outcoupler at an end of the known path for transferring the sound energy from the surface wave to the air continuing substantially in a direction of propagation of the surface wave when it reaches the end of the known path.

18. A surface wave apparatus as defined in claim 17 comprising a microphone disposed proximate the surface along the known path and for sensing sound energy within the surface wave.

19. A surface wave apparatus as defined in claim 1 comprising a microphone disposed proximate the surface along the known path and for sensing sound energy within the surface wave.

20. A surface wave apparatus as defined in claim 19 wherein the microphone is disposed only within a single path.

21. A surface wave apparatus as defined in claim 1 comprising:

an acoustically transparent material disposed proximate the first surface to at least partially close the plurality of cells along the known path.

22. An air coupled surface wave apparatus having reduced sound attenuation across a surface along a first known path having a first path distance when compared to sound attenuation along a same first path distance through air and having reduced sound attenuation across the surface along a second known path having a second path distance when compared to sound attenuation along a same second path distance through air comprising:

a plurality of cells defining a first surface for supporting acoustical communication between a sound field incident on the first surface and the plurality of cells, each cell including:

an end that is approximately acoustically sealed such that most acoustic energy does not pass therethrough and spaced from the first surface for providing an effective acoustic surface impedance for which air-coupled surface waves form and propagate at selected sound frequencies, at least a bounding sidewall between the first surface and the end having opposing sides spaced apart by a distance less than a wavelength of sound at a known frequency and each disposed across the first known path and the second known path on the surface wave apparatus, wherein the first path and the second path are other than straight orthogonal paths.

23. An air coupled surface wave apparatus having reduced sound attenuation across a surface along a known path having a path distance when compared to sound attenuation along a same path distance through air comprising:

a plurality of cells defining a first surface for supporting acoustical communication between a sound field incident on the first surface and the plurality of cells, each cell including:

an end that is approximately acoustically sealed such that most acoustic energy does not pass therethrough and spaced from the first surface for providing an effective acoustic surface impedance for which air-coupled surface waves form and propagate at selected sound frequencies, at least a bounding sidewall between the first surface and the end having opposing sides spaced apart by a distance less than a wavelength of sound at a known frequency and each disposed across the known path of the surface wave apparatus; and, an outcoupler disposed at the second end for coupling the sound out of the surface wave device.

24. A surface wave apparatus as defined in claim 23 wherein the outcoupler comprises a flat solid surface approximately coplanar with the surface.

25. A surface wave apparatus as defined in claim 23 wherein the outcoupler comprises at least a modified sidewall of the surface wave apparatus at a perimeter thereof.

26. A surface wave apparatus as defined in claim 23 wherein the outcoupler comprises at least a modified cell at a perimeter of the surface wave apparatus.

27. A surface wave apparatus as defined in claim 23 wherein the surface wave apparatus is a self contained portable static structure.

28. A surface wave apparatus as defined in claim 27 wherein the surface wave apparatus in a table top.

29. An air coupled surface wave apparatus having reduced sound attenuation across a surface when compared to sound attenuation through air comprising:

a plurality of cells including at least a bounding sidewall having bounding sides and a closed end that is approximately acoustically sealed such that most acoustic energy does not pass through disposed along a path on the surface wave apparatus and a second other opposing end to the closed end for supporting acoustical communication between a sound field incident on the second other opposing end and the plurality of cells, the bounding sides of each cell spaced apart by a distance less than a wavelength of sound at a known frequency and a distance between the closed end and the second other opposing end selected for giving an effective acoustic surface impedance for which air-coupled surface waves form and propagate at selected sound frequencies; and a microphone disposed proximate the surface wave apparatus and located for sensing surface waves formed on the surface wave apparatus and for recording thereof.

30. A surface wave apparatus as defined in claim 29 wherein the microphone is disposed at a location where two different known paths cross, each path for conducting a surface wave.

31. A surface wave apparatus as defined in claim 29 comprising a second other microphone disposed proximate the surface wave apparatus and located for sensing other surface waves formed on the surface wave apparatus and for recording thereof.

32. A method for having reduced sound attenuation across a surface along a known path having a path distance when compared to sound attenuation along a same path distance through air comprising:

providing an audible sound wave to a surface comprising a plurality of cells each having a gas therein;

forming a first air coupled surface wave along the surface for frequencies within a first range of sound within the provided sound;

forming a second other air coupled surface wave along the surface for frequencies within a second range of sound within the provided sound;

damping the intensity of the second other surface waves;

recombining one of the first and the second surface wave and sound formed upon outcoupling of the first and second surface wave to form shaped sound.

33. A method according to claim 32 wherein the damping of the second other surface wave is provided through a use of materials disposed within the surface wave path for attenuating the surface wave.

34. A method for having reduced sound attenuation across a surface along a known path having a path distance when compared to sound attenuation along a same path distance through air comprising the steps of:

providing an acoustic source location;

providing a plurality of surface wave paths between the acoustic source and one of a sensor location or a listener location;

providing a plurality of cells along each of the surface wave paths, the cells having a depth selected to support surface waves for sound within a known frequency range and the distance between cell sides along the surface wave path being substantially less than a wavelength of sound at any frequency within the known frequency range; and, providing for relatively damping of surface wave intensity between different surface wave paths.

35. A method according to claim 34 wherein the relative damping is provided through a use of static objects and materials disposed within one of the surface wave path and the cells.

36. A method according to claim 34 used for designing auditoria.

* * * * *